US005722206A

United States Patent [19]

McDonald

[11] Patent Number: 5,722,206

[45] Date of Patent: Mar. 3, 1998

[54] FLEXIBLE STORM RESISTANT SYSTEM

[76] Inventor: Kenneth J. McDonald, 4063 Vine La., Naples, Fla. 34112

[21] Appl. No.: 738,536

[22] Filed: Oct. 28, 1996

[51] Int. Cl.[6] ..... E06B 9/00

[52] U.S. Cl. ..... 52/202; 49/57; 49/62; 49/463; 49/465

[58] Field of Search ..... 52/202, 203; 49/50, 49/57, 61, 62, 463, 465

[56] References Cited

U.S. PATENT DOCUMENTS

| | | | |
|---|---|---|---|
| 980,535 | 1/1911 | Kleinegger | 49/57 |
| 2,549,661 | 4/1951 | Carney | 52/202 |
| 2,622,285 | 12/1952 | Roos | 52/202 |
| 2,777,174 | 1/1957 | Carr | 49/465 |
| 2,800,103 | 7/1957 | Bleeker | 49/465 X |
| 2,827,960 | 3/1958 | Keating et al. | 49/57 X |
| 3,745,704 | 7/1973 | Covington | 49/57 |
| 4,461,119 | 7/1984 | Smith | 49/62 X |
| 4,562,666 | 1/1986 | Young, III | 49/62 |
| 4,624,500 | 11/1986 | Heitman | 49/50 X |
| 4,726,149 | 2/1988 | Tybra | 49/61 X |
| 5,335,452 | 8/1994 | Taylor | 49/57 X |
| 5,507,118 | 4/1996 | Brown | 49/465 X |

*Primary Examiner*—Wynn E. Wood
*Assistant Examiner*—Laura A. Callo

[57] ABSTRACT

The invention relates to a flexible storm resistant system for installation in openings of a dwelling. The system consists of hinged support braces that are installed in the lateral walls of an opening. The braces have horizontally extending threaded bolts placed inwardly from their ends. The braces also have retainer pins at each of their ends to be received in bores of the lateral walls. A panel having a periphery larger than the opening is received onto the bolts of the braces and rigid splints having holes corresponding to the location of the bolts are received over the panel and over the bolts to sandwich the panel between the supporting braces and the splints. There are nuts at the ends of the threaded bolts to apply appropriate pressure to the above noted sandwich.

5 Claims, 3 Drawing Sheets

FLEXIBLE STORM RESISTANT SYSTEM

BACKGROUND OF THE INVENTION

This application is a Substitute for application Ser. No. 08/151,175, filed on Mar. 1, 1994, now abandoned.

This invention relates to a system for securing openings in dwellings against high winds of the hurricane category which may exhibit winds of up to 150 miles/hr. The openings in many types of dwellings include windows such as casement windows, sliding windows either horizontally or vertically of all different sizes, double door patio doors, single or french-type entrance doors and single and double garage doors. The aim in providing storm resistant systems in all of the above named openings is to provide a storm resistant envelope around the dwelling so that high velocity winds as well as flying debris carried by the same cannot enter the dwelling by penetrating any of the openings to thereby destroy the integrity of the envelope of the dwelling.

If any of the openings are breached, that will result in the eminent destruction of the dwelling because the high velocity force of the winds may now enter the dwelling creating a pressure against the roof, while the high velocity of the winds streaming over the roof creates a suction which inevitably takes the roof off the house. Of course, water damage to what remains standing and to the contents of the dwelling is a further result of the breach of the envelope of the dwelling.

DISCUSSION OF THE PRIOR ART

It is common to board-up openings when the threat of a hurricane is announced with various types of panels to protect glass windows and doors against shattering from debris colliding at high velocity and even small projectiles can penetrate the above identified openings. All of the above named openings are set back from the face of the structure or dwelling. Most of the dwellings are frame construction or hollow cinder block or concrete block construction.

In many instances, corrugated metal panels are fastened over the openings and are fastened over the openings by top and bottom rails which remain in place at all times even in non-hurricane seasons. Of course, the rails are very unsightly and distract from the clean lines of the dwelling. Other of the corrugated panels are fastened to the openings by screws screwed into permanent anchors which are placed into the flush walls surrounding the openings. These again are permanent installations that are very unsightly and, of course are subject to corrosion. Hurricane force winds of one hundred miles/hr. and higher are known to set up harmonic vibrations that will result in rattling loose the above described installation because of the metal to metal contact between the fasteners and the corrugated metal panel. Further, anchors of various types are also prone to failure because of progressive corrosion from the salt air environment common to coastal areas. In addition, anchors driven into blocks which are hollow and only ½ inch thick are inadequate to hold a large force from shaking loose during a major storm. Also, most homeowners have no experience in nailing into concrete and any nailing close to the edge of an opening will simply break the block away behind the panel and any anticipated holding power is greatly diminished from this common mistake.

While plywood is considered to be an excellent protective covering for windows and doors, however, if they are not properly fastened or supported against the dwelling, their full potential is not being taken advantage of.

U.S. Pat. No. 5,335,452 issued to Taylor on Aug. 9, 1994 depicts a hurricane panel system that utilizes numerous parts and metal fixtures that are designed to secure the panels to the framework of an opening. The problem with the Taylor design is that by using a series of wing nuts, bolts and metal fabricated parts which tend to become misplaced or lost and by using wing nuts to hold the system together, it is prone to failure as it is highly unlikely that a person could hand tighten a wing nut with sufficient force to withstand 4 to 6 hours of intense multi-directional vibrations encountered during a major storm.

Also, this Taylor design would require long and cumbersome braces to handle and store and to adequately span a large opening such as a garage door or a series of contiguous sliding glass doors.

U.S. Pat. No. 4,726,146 issued to Taylor on Feb. 23, 1988 consists of a single pre-sized panel with hand holds mounted thereon which can be utilized to install the panel from the inside of a dwelling.

This design, although handy to install on upper level openings, could be problematic due to the slide bolts vibrating out of their respective recesses during a severe flexing inherent with a thin panel that has no structural framework. In addition, the panel appears in FIG. 3. C to fit extremely close to the existing window and does not provide any area to flex inwardly under wind pressure or the shock from flying debris.

In addition, the fasteners used to connect the slide bolts to the panel appear to be no longer than the thickness of the panel and their ability to hold securely will be unlikely.

OBJECTS OF THE INVENTION

An object of the invention is to provide stable but flexible frameworks to which plywood panels may be securely fastened. This framework is unique because it may flex inwardly and outwardly without structural failure due to vibration and collision from high velocity winds and/or flying debris.

The flexible storm resistant system is quickly installed or removed and requires no unsightly or permanent rails or other mechanical devices that may corrode or jam. It further avoids the use of unsightly surface mounted fasteners such as nails, concrete anchors or bolts that cause visual pollution and surface damage when removed. All that can be seen from the outside when the system is installed is nuts over washers within the perimeter of the panels. When removed nothing remains attached to the dwelling and no holes or anchors that can readily be seen by a casual observer.

DETAILED DESCRIPTION OF THE DRAWINGS

Figure 1:
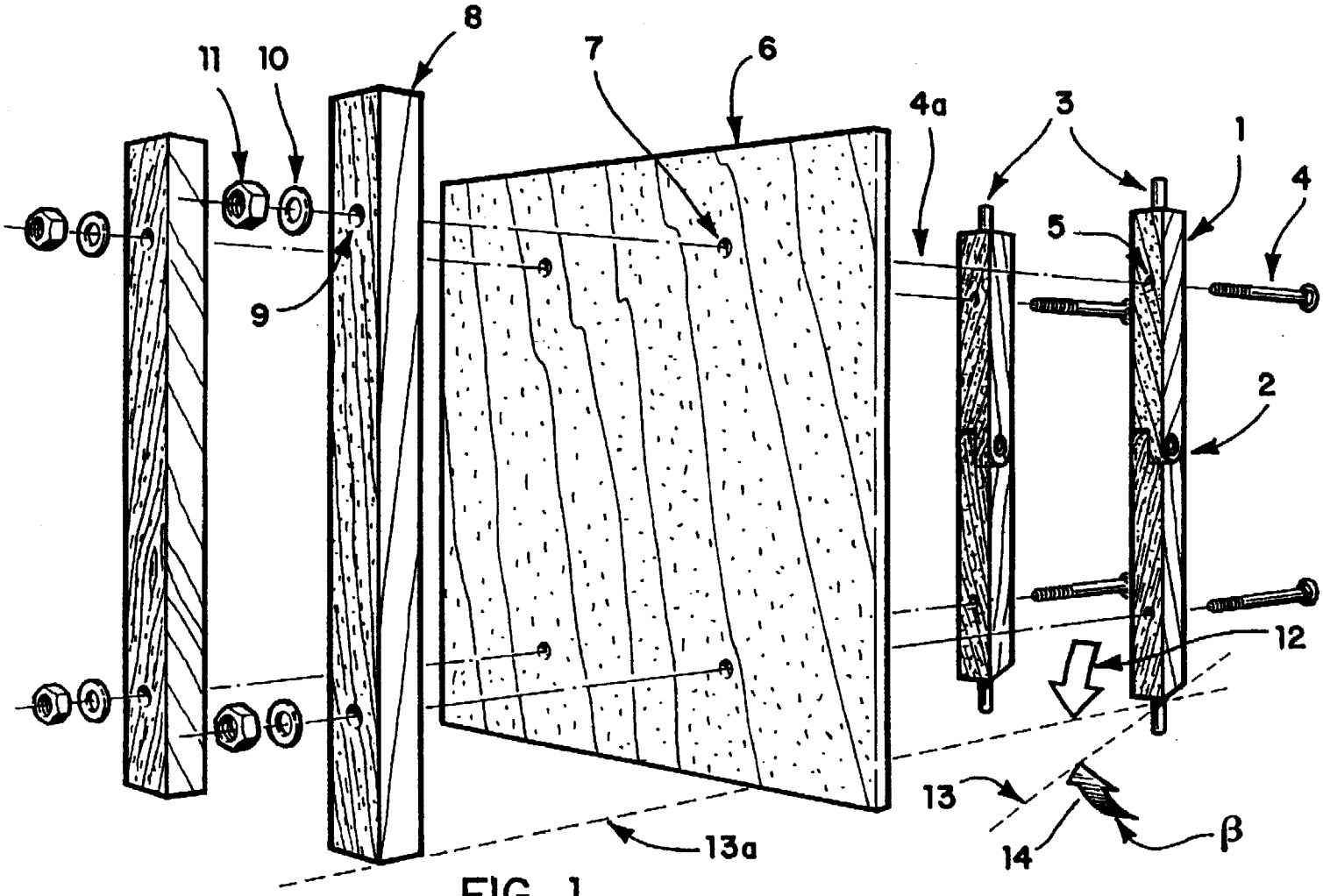
FIG. 1 shows an exploded and perspective view of the invention prior to assembly.
Figure 2:
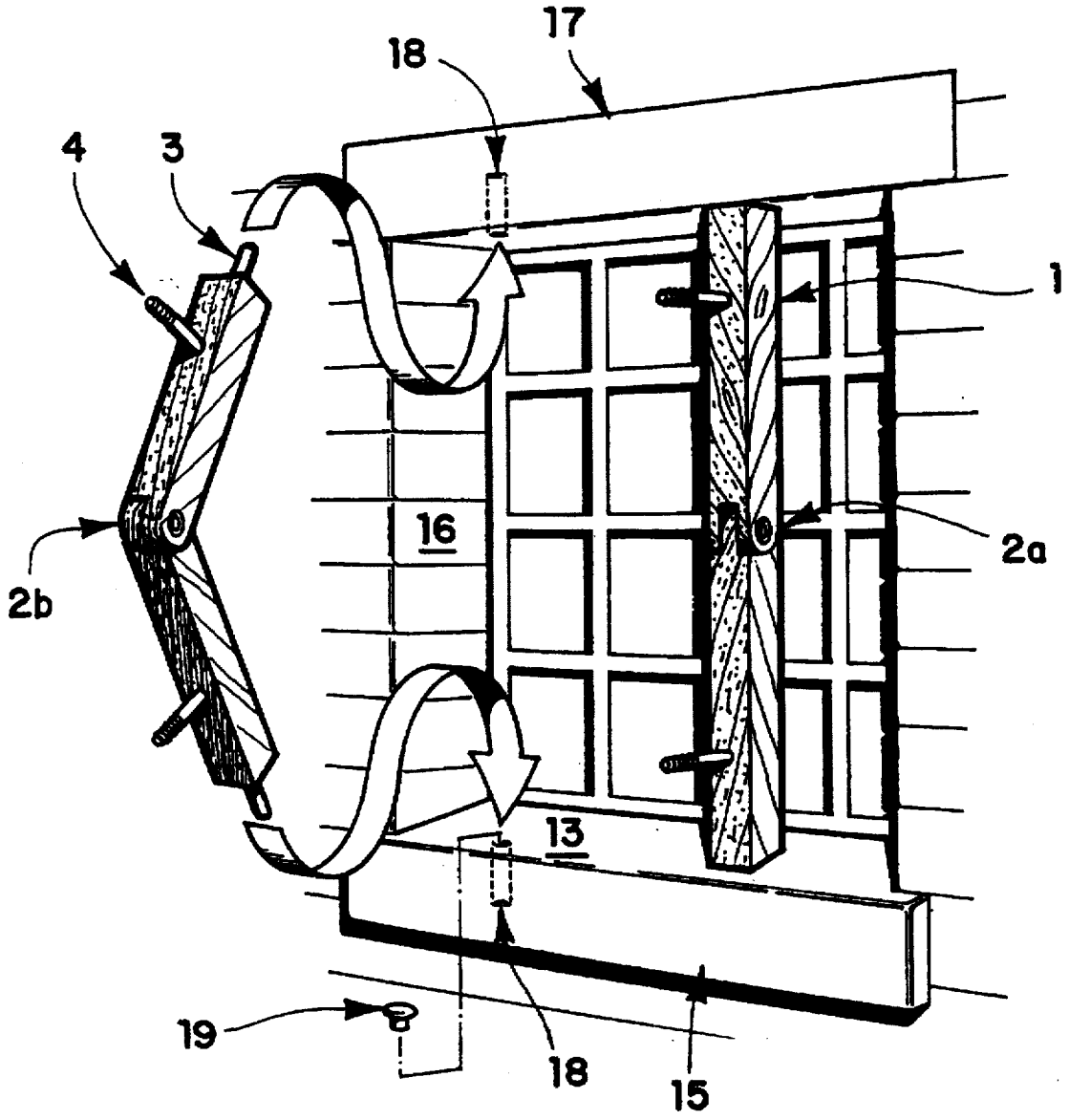
FIG. 2 shows a perspective view of the invention at the beginning stage of its assembly.
Figure 3:
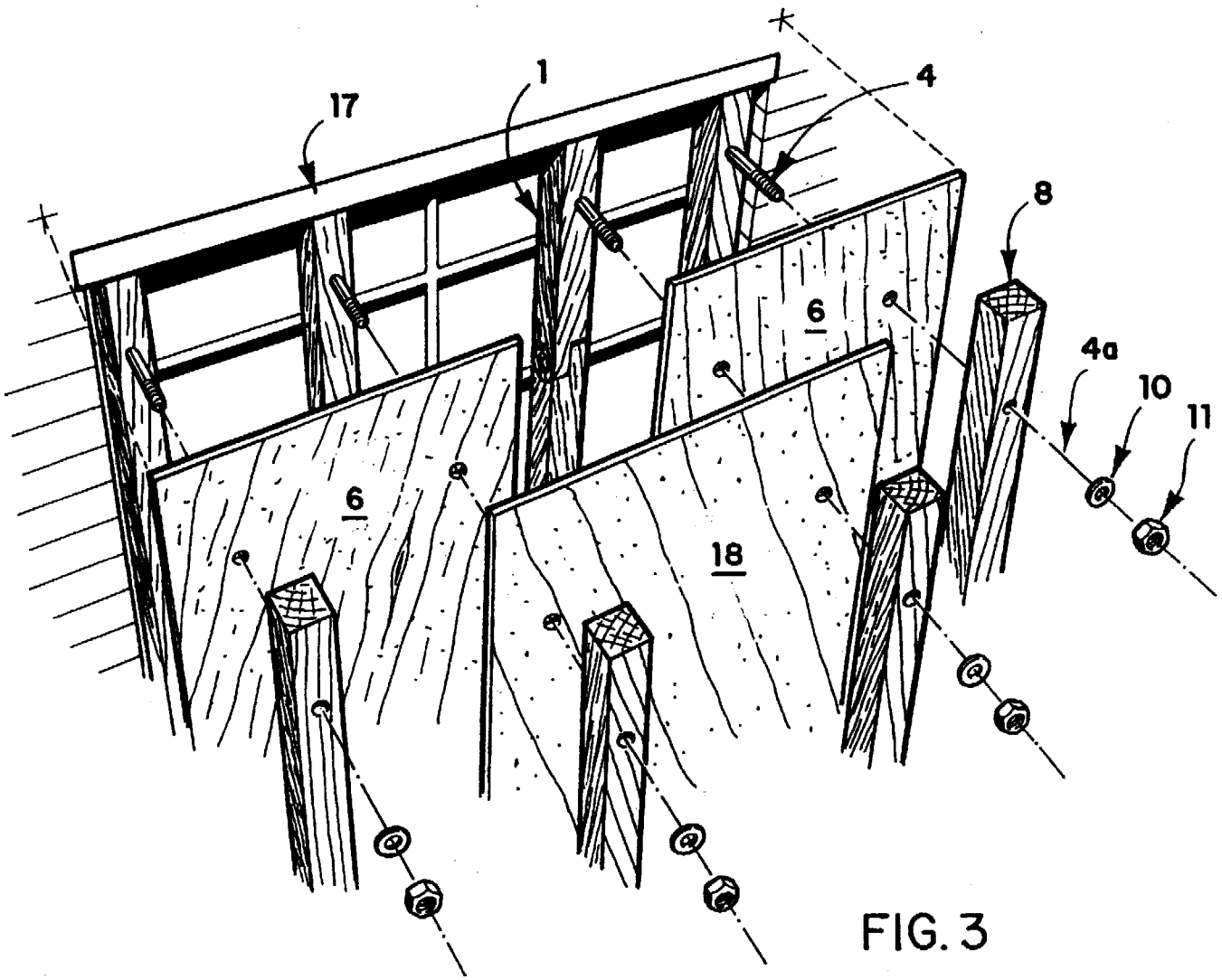
FIG. 3 shows an exploded and perspective view of the invention as it is assembled over a greater width of an opening.

FIG. 1 shows the proper sequence of the various elements of the storm resistance system of the invention. In a typical window opening (shown in FIG. 2) the first elements to be installed are two support braces 1 which are hinged at 2. The hinge itself can be a tongue and groove-type hinge **2*a* or half laps 2*b* from each of the two parts bolted together. The braces themselves are obtained from lumber stock material such as wooden 2×4's. At each end of the braces there are two retaining pins 3 secured therein. Each of the support braces have bolts 4 placed therein in holes 5 inwardly from their ends. The bolts can be of the carriage type having threaded ends. Once the support braces 1 are properly installed, the bolts 1 assume a substantial horizontal position as indicated by the phantom lines 4***a* in FIGS. 1 and 3. Once the support braces are in place, a panel 6 having holes 7 is placed next to the braces so that the holes 7 can receive the bolts 4. After that, the splints 8 having holes 9 are moved next to the panel 6 by receiving bolts 4 through their holes 9 so that the panel 6 is sandwiched between the support braces 4 and the splints 8. After that, washers 10 are placed over the bolts 4 followed by threading the nuts 11 onto the threaded ends of the bolts 4. The installation of the storm resistant system will now be described as follows:

FIG. 2 shows a typical window opening of a dwelling. The window is normally recessed from the outer wall and thereby has lateral walls 16. The upper lateral wall normally consists of a lentil 17 which can be somewhat protruding from the wall of the dwelling or it can be flush therewith. Also, most window openings have a sill block which is slanted downwardly forwardly as indicated by phantom line 13 in FIG. 1 and thereby forms an angle β between phantom line 13 and phantom line 13*a* as indicated by arrows 12 and 14. Before installing the storm system in the dwelling, bores 18 are drilled into the lentil 17 and the sill 15 to receive the retainer pins 3 therein. These are the only bores required in installing the whole system. The bores, when not in use, are plugged by plastic plugs 19 (FIG. 2) to keep them clean and to hide them from view. The support braces 1 are now cut to their proper length including the angle β, that is, the slant of the sill. Thereafter, the retainer pins are installed in the ends of the braces either by threading or by other ways of fastening. The braces 1 are now hinged as is shown on the left side of FIG. 2 and the retainer pins 3 are lined up with bores 18 and the support brace 1 is straightened out (see arrows) whereby the retainer pins 3 will enter bores 18 until fully seated therein when the braces 1 attain a straight position as shown on the right side of FIG. 2. Panel 6 is now installed over the braces 1 by passing it over the bolts 4 through the holes 6. Next follows the installation of the splints 8 by passing the bolts through the holes 9 of the splints to thereby sandwich the panel there between The washers 10 are now passed onto the bolts 4 and the nuts 11 are now threaded thereon. A wrench should be used to tighten the nuts so that quite a pressure is asserted between the sandwiched system to preclude any vibrations from loosening any of the components. Wing nuts in lieu of nuts 11 have been contemplated but it is believed that hand tightening of wing nuts is not sufficient to create the above noted tensioning. Tests have been conducted with high velocity water cannons and projectile shooting machines and they all have shown that the installed system is flexible but it retains its integrity.

Many dwellings not only have single window openings but larger openings such is sliding patio doors and single and double garage door openings that need to be protected. The above noted system is equally protective when installed as described hereinafter and with reference to FIG. 3. Larger openings require an equal number of support braces 1 and an unequal number of panels. Thus, in FIG. 3 there are installed four support braces 1 and the two left handed braces 1 receive one panel 6 over their respective bolts 4 and the two right handed braces receive a panel over their respective bolts 4. It can be seen that a gap is left between the now installed panels 6. A third panel 18 is now installed over the gap and is received over the bolts 4 of the two inner braces and this panel 18 will overlap the two previously installed panels 6. The splints 8 are now placed over all bolts 4 and the nuts 11 are now tightened as explained above. Larger openings require more support braces yet and of course more panels, but the principle as explained above remains the same. An equal number of braces and an unequal number of panels, as long as any other panel overlap each other. It is also pointed out that larger openings require the use of larger lumber sizes. Thus, on a double garage door opening, the 2×4's should be 2×6's, for example.

Some windows and entrance doors have an arched extension on their top. To protect such structures the same principle as explained in connection with large openings is adopted. Once the main opening is protected, another brace is installed in the arch in a horizontal position and an appropriately sized panel is placed over the bolts 4 and a horizontal splint is installed over the bolts 4. Everything else remains the same. The same principle applies for circular windows or windows resembling a circle. Again, a horizontal hinged brace 1 is installed within the opening and an appropriately sized panel is placed over the bolts and a horizontal splint is placed over the bolts 4 and the panel 6 and the nuts 11 are tightened to their appropriate tension.

What I claim is:

1. A flexible storm resistant system mounted in an opening in a wall of a dwelling, said opening being flush with said wall but having lateral walls surrounding said opening, bores are provided in the lateral walls of said opening, said system includes hinged support braces, said support braces having protruding retainer means at each end thereof, at least two of said support braces are mounted within said opening by said protruding retaining means being received in said bores, said support braces having threaded bolts horizontally protruding therefrom and an impact resistant panel having a periphery larger than said opening and having holes receiving said horizontal bolts, and rigid splints having holes corresponding to the location of said horizontal bolts and being received over said bolts to sandwich said impact resistant panel between said support braces and said splints and means applying pressure between said support braces, said impact resistant panel and said splints through said bolts.

2. The flexible storm resistant system of claim 1, wherein openings of a size requiring more than one of said impact resistant panels are to be protected including at least an equal number of said hinged support braces and an unequal number of said impact resistant panels, wherein every other impact resistant panel will overlap each other.

3. The flexible storm resistant system of claim 2, wherein the equal number is four and the unequal number is three.

4. The flexible storm resistant system of claim 1, wherein the support braces are hinged by tongue and groove hinges.

5. The flexible storm resistant system of claim 1, wherein the support braces are hinged by half lap hinges.

* * * * *